United States Patent [19]

Grevich

[11] 4,336,680

[45] Jun. 29, 1982

[54] STAINLESS STEEL TRANSPORT BAND

[75] Inventor: John J. Grevich, Star Prairie, Wis.

[73] Assignee: Nordson Corporation, Amherst, Ohio

[21] Appl. No.: 109,657

[22] Filed: Jan. 4, 1980

[51] Int. Cl.[3] ..... B65B 41/14

[52] U.S. Cl. ..... 53/389; 226/173

[58] Field of Search ..... 53/389, 559, 329, 548, 53/300; 226/173, 171

[56] References Cited

U.S. PATENT DOCUMENTS

| | | | |
|---|---|---|---|
| Re. 299,937 | 3/1979 | Mahaffy et al. | 53/559 X |
| 3,029,007 | 4/1962 | Hepner | 226/173 |
| 3,303,628 | 2/1967 | Lovas et al. | 226/173 |
| 3,653,175 | 4/1972 | Rogiers | 53/559 |
| 3,767,349 | 10/1973 | Jesuit | 53/559 X |
| 3,773,235 | 11/1973 | Canamero et al. | 226/173 X |

*Primary Examiner*—Horace M. Culver

*Attorney, Agent, or Firm*—Peterson, Palmatier, Sturm and Sjoquist

[57] ABSTRACT

A plastic film carrier for a vacuum packaging machine comprising a continuous stainless steel band with clips thereon for securing the edges of the web of plastic film onto the face of the band, the band having openings therein receiving sprocket teeth to lift the clips out of clamping relation with the film.

1 Claim, 7 Drawing Figures

STAINLESS STEEL TRANSPORT BAND

This invention relates to vacuum packaging machines and more particularly to endless stainless steel drive bands for carrying and conveying the deep-drawing plastic film material.

BACKGROUND OF THE INVENTION

Vacuum packaging is used for many different types of goods, but is particularly useful in packaging food stuffs, including meat items such as sausages, sliced sandwich meat, steaks, chops, and also other related items for retail distribution, including cheese, poultry, fish, various dairy products and bakery products, vegetables and fruit, and various powders and liquids in measured quantities.

In such vacuum packaging machines, a web of plastic film is drawn into the machine, heated and deep drawn to define compartments for containing the items to be packaged. The edges of the traveling plastic film have previously been carried in clips mounted on continuous roller chains. The use of such roller chains in close proximity to foodstuffs is quite unsatisfactory because the chains present an unsanitary condition which cannot easily be corrected. At best, health inspectors tolerate these conveyor chains upon which the edges of the plastic film are carried, in recognition that the industry has not previously had a suitable substitute for such roller chains in this type of a vacuum packaging machine.

The entire machine including such roller chains are steam cleaned daily in an effort to maintain a sanitary condition, and accordingly, it is almost impossible to lubricate the chains to make them operate properly. Rusting of the roller chains results, and the lack of lubrication oftentimes produces excessive wear causing stretching of the roller chains. As a result, frequent adjustments must be made and these chains must be periodically replaced.

In a vacuum packaging machine the adjustment problems occasioned by wear of the chain links soon become problems of major concern. Because of the long lengths of the chains utilized for moving the web of plastic along numerous work stations, a minute amount of wear at each chain link will accumulate to a substantial lengthening of the entire chain.

The numerous work stations include heating and shaping the plastic; loading the compartments, sometimes by machine; positioning the top or covering web of plastic; sealing the top web to the shaped web; cutting the continuous web into discrete packages; and punching holes in the edge portions of the packages. Accordingly, unintentional lengthening of the chains requires adjustment and re-indexing of the mechanism at all of these stations, which is a project of major proportion.

SUMMARY OF THE INVENTION

An object of the invention is to provide a new and improved drive and carrier for the plastic film underlying the goods being packaged in a vacuum packaging machine.

Another object of the invention is to provide a novel plastic film carrier well adapted to grip the edges of the web of film upon which foodstuffs are carried, which carrier may be maintained in a clean and sanitary condition.

A further object of the invention is to provide a novel carrier of uniform and constant size for moving the plastic film to and past numerous work stations without requiring re-indexing of the mechanism at the various work stations.

Still another object of the invention is the provision of an improved plastic film carrier for a vacuum packaging machine which carries the edge of one plastic film and facilitates sealing of another film closely adjacent the edge in such a manner as to minimize any wastage of plastic film.

A feature of the invention is the provision of a plastic film carrier for machines such as a vacuum packaging machine, in the form of a continuous stainless steel band having clips thereon to grip and carry the edge of the plastic film for supporting the film and drawing it through the machine.

Another feature of the invention is the mounting of the stainless steel band upon toothed sprockets wherein the sprocket teeth protrude through apertures in the stainless steel band and engage each clip to open the clip for receiving the edge of the film to be clamped.

Still another feature of the invention is in the use of a removable hinge pin to hold the ends of the stainless steel band together, but permitting separation of the ends for replacement of the band. Similarly, the spring clips are readily removable for ready and easy cleaning.

The principal advantages which stem from these features are that very sanitary conditions can be established and maintained in the carrier for the edges of the plastic film upon which foodstuffs are carried. Also, the stainless steel band with film anchoring clips is simple, trouble-free, and not subject to significant wear or breakdown.

Another very important advantage of the stainless steel transport band is that the band has no tendency to stretch or inadvertently lengthen. The band is in one flexible strip and remains of uniform length all through its long operational life, thus avoiding the need to readjust the mechanisms at the various work stations from time to time.

In addition, an edge portion of the stainless steel band provides support for the edge of the plastic film so that a second covering of film may be laid upon the edge and heat sealed to the lower film, as to minimize any possible wastage of material.

A further advantage of the present invention which stems from the construction is that the carrier for the film will have an exceedingly long operational life which may exceed three years without need for replacement. Furthermore, the stainless steel carrier band may move into and through the vacuum chamber of the vacuum packaging machine, making design of the machine significantly simpler.

DETAILED SPECIFICATION

Figure 1:
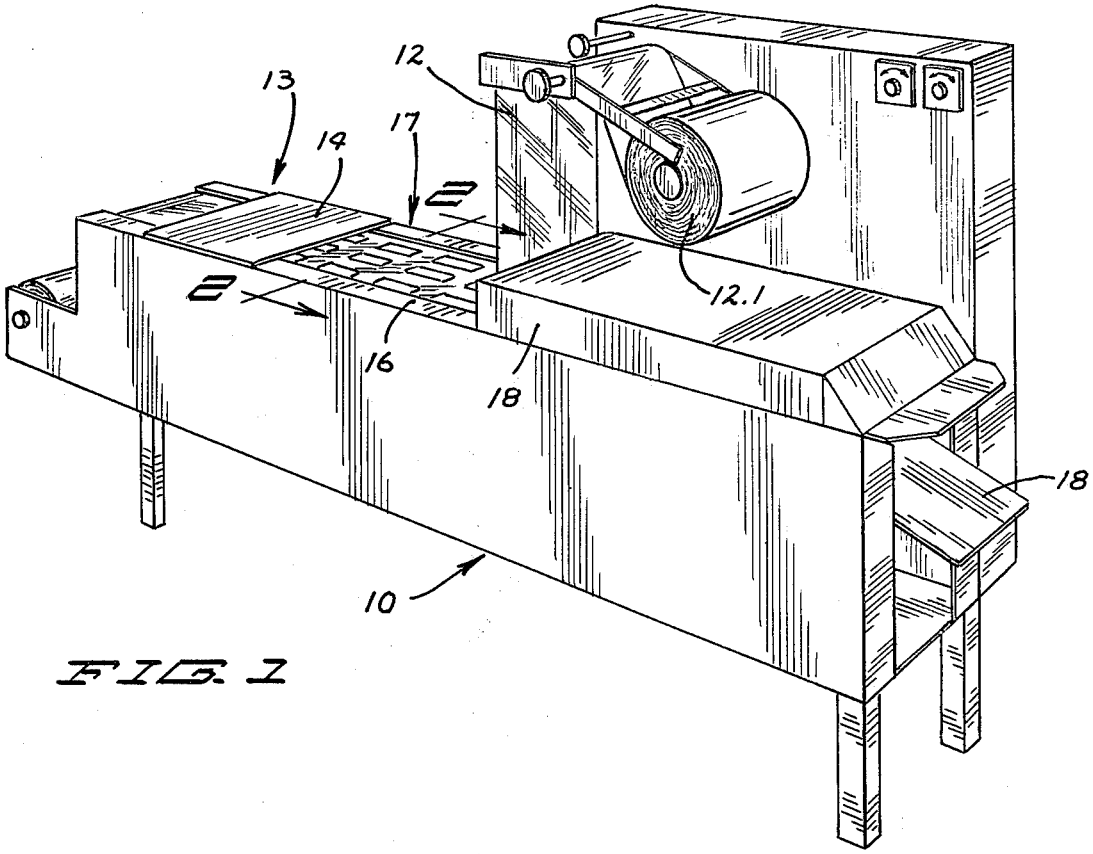
FIG. 1 is a perspective view of a vacuum packaging machine utilizing the present invention.
Figure 2:
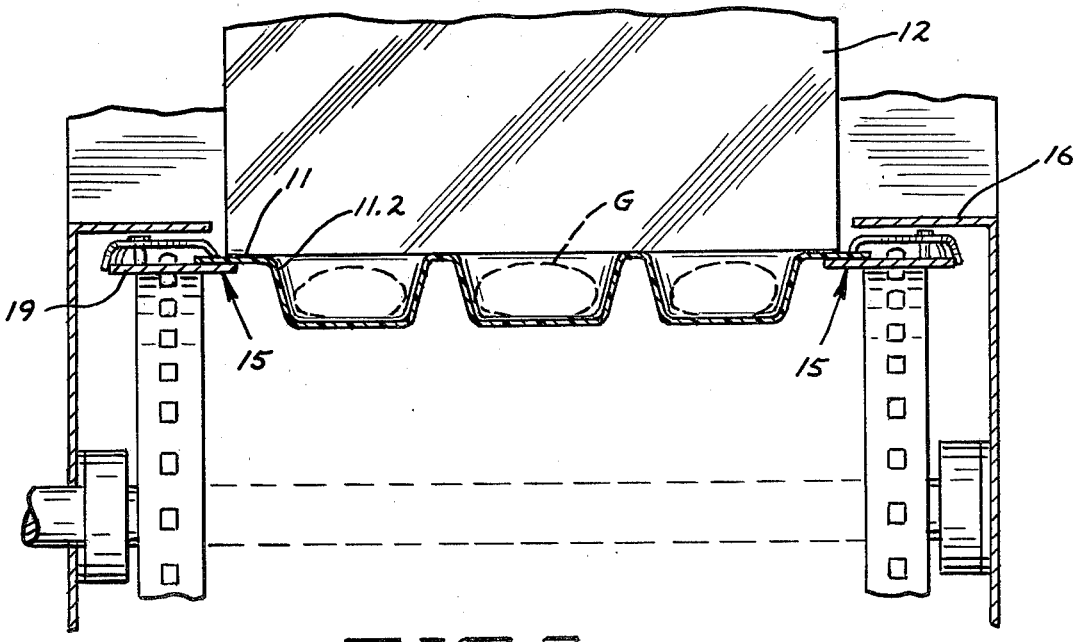
FIG. 2 is an enlarged detail section view taken approximately at 2—2 in FIG. 1.
Figure 3:
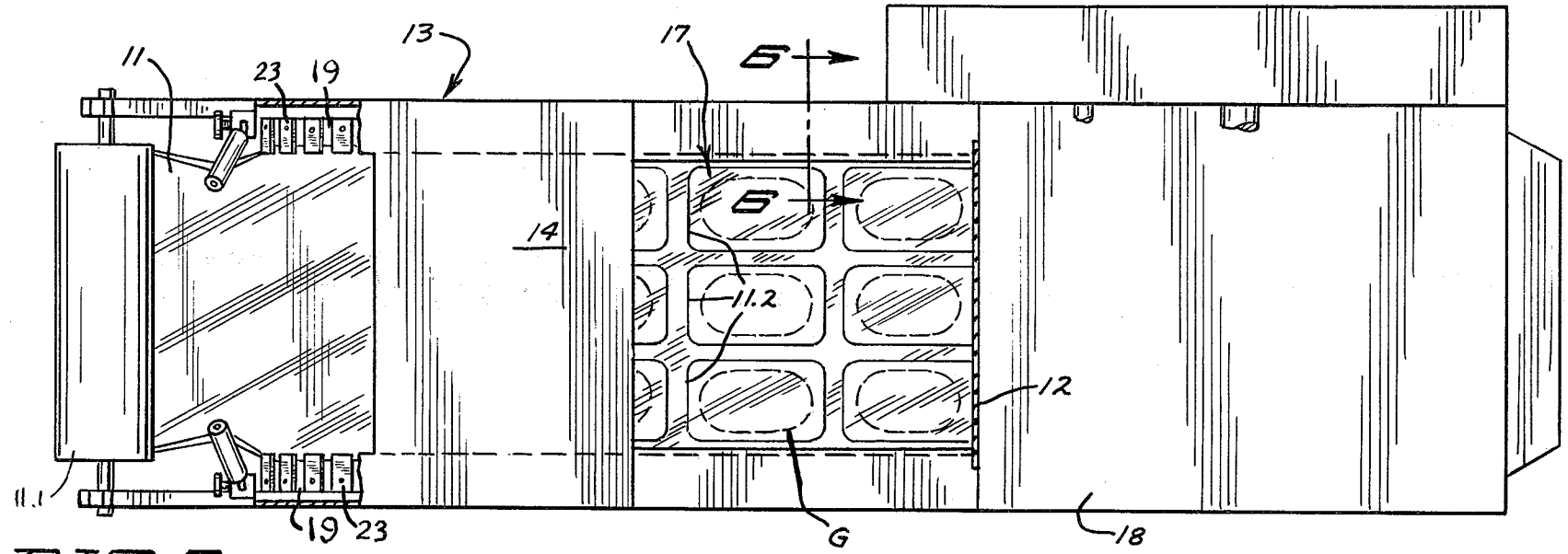
FIG. 3 is a top plan view of the machine with portions thereof broken away for clarity of detail.
Figure 4:
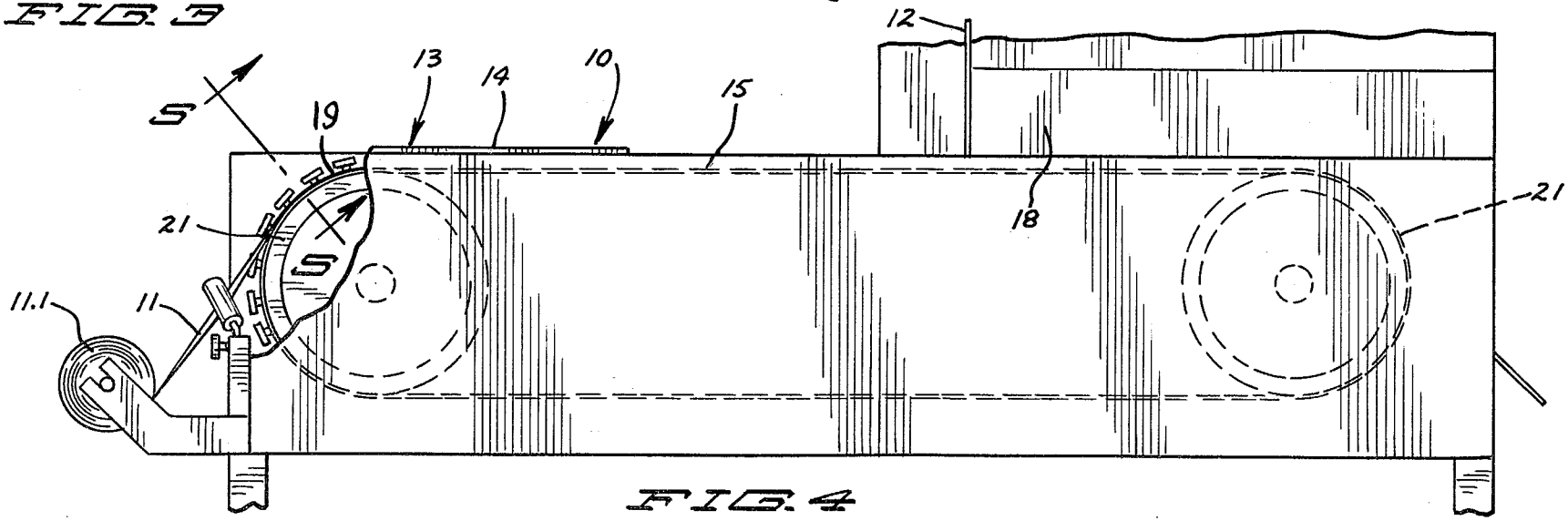
FIG. 4 is a detail side elevation view of the vacuum packaging machine.
Figure 5:
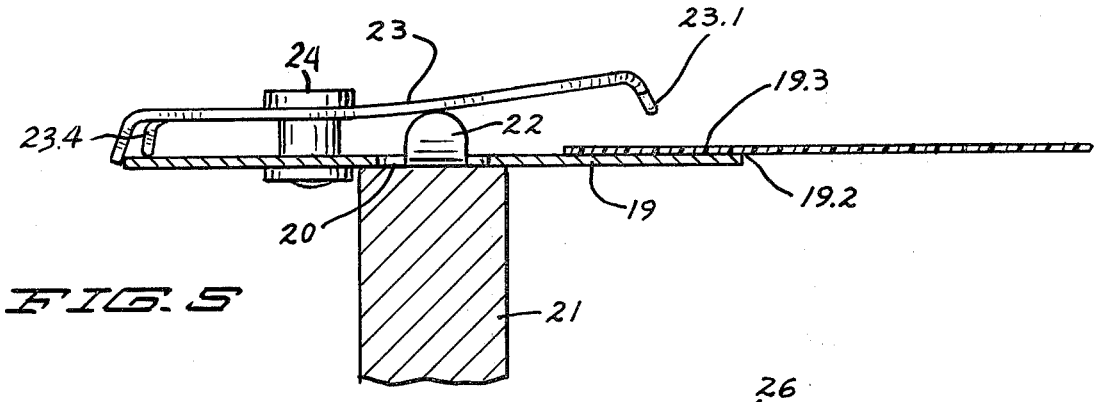
FIG. 5 is an enlarged detail section view taken approximately at 5—5 of FIG. 4.
Figure 6:
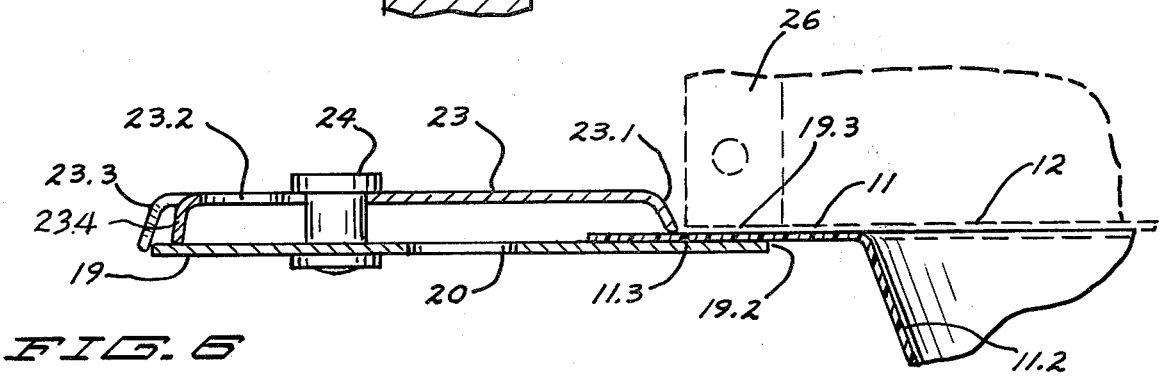
FIG. 6 is an enlarged detail section view taken approximately at 6—6 of FIG. 3.
Figure 7:
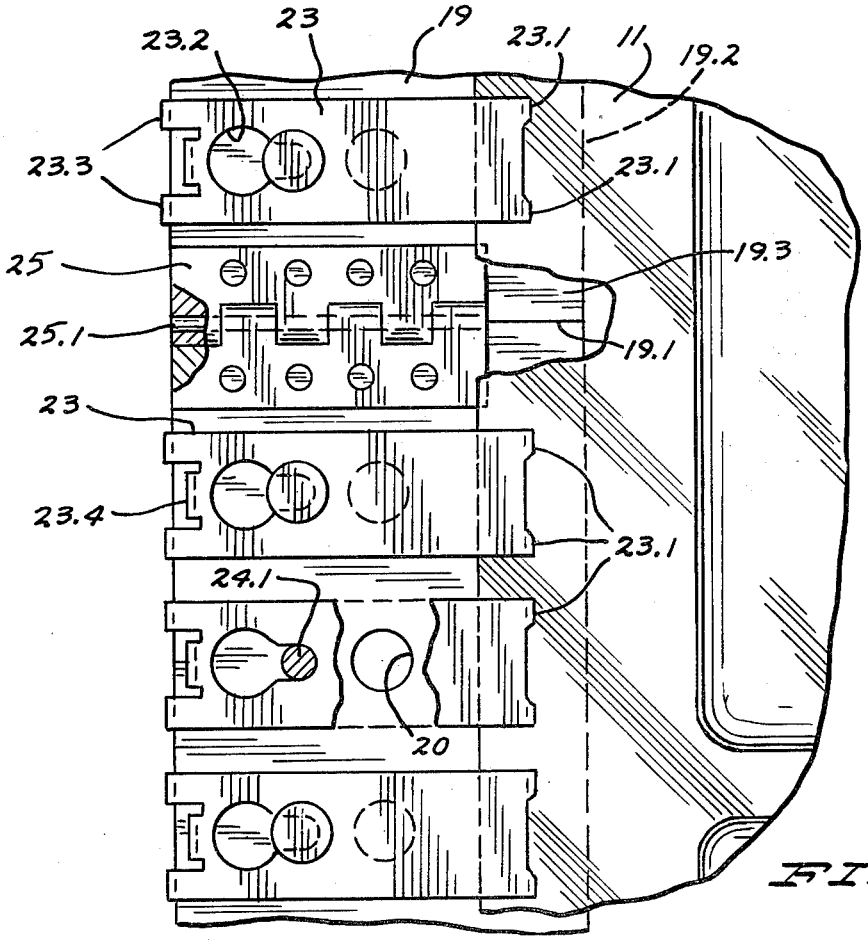
FIG. 7 is an enlarged detail plan view of a portion of the band as illustrated in FIG. 6.

One form of the invention is shown in the drawings and is described herein. A typical vacuum packaging machine is illustrated in FIG. 1 and is indicated in general by numeral 10. The vacuum packaging machine utilizes two separate webs 11 and 12 of plastic film to form the wrapper or package in which articles or items of goods G will be confined. The webs 11 and 12 of plastic film are drawn from rolls 11. 1 and 12.1, respectively. The two webs 11 and 12 will be joined together to confine the item of goods G therebetween by heat sealing, and accordingly, the top web 12 will be a heat sealable laminate film, and the bottom web will be a heat sealable or thermoformable laminate film, flexible or rigid.

As the bottom web 11 enters the machine, it passes through a forming station 13 at which there is a heated plate 14 for softening the web 11 of plastic material. At this forming station 13 the web 11 has the pockets or receptacles 11.2 formed therein. The web is gripped and supported by carriers 15 at the opposite side edges of the web 11. These carriers 15 are substantially confined beneath the housing 16 and move the web 11 intermittently through the machine. After the pockets or receptacles 11.2 are formed in the web 11, the pockets pass by a filling station 17, at which location a person will place the items of goods G into the pockets or receptacles 11.2. Alternately, the items G may be automatically fed to the pockets at filling station 17.

After the items of goods G are placed in the pockets 11.2, the top web 12 is moved downwardly to overlie the receptacles or pockets 11.2 and to lie flush against the top of the bottom web 11. The two webs 11 and 12, lying flush against each other, then pass into a vacuum chamber 18 wherein a vacuum is drawn in each of the covered receptacles 11.2, and then to a sealing station where the top web 12 is sealed to the bottom web, along both sides of the bottom web 11 and around the periphery of each of the receptacles 11.2. Thereafter, the webs progress to a cutting station where the packages are severed from each other and they will be discharged at the outlet chute 18 seen in FIG. 1. The packages may be punched as well as cut in some instances.

The two carriers 15, one at each side edge of the bottom web 11, are well illustrated in FIGS. 4–7. Both of the carriers 15 are identical for gripping the opposite side edges of the web 11.

The carriers 15 include a pair of elongate endless stainless steel bands 19. Each band 19 is typically two and a half inches wide with a thickness of 0.040 inches. Each band 19 has a multiplicity of apertures 20 therein, and is flexed and trained about toothed sprockets 21 adjacent opposite ends of the machine. Each of the bands travels about this endless course without being permanently deformed or stretched. The teeth 22 of the sprockets protrude through the apertures 20 in the band to synchronize the movement of the two bands 19 with respect to each other.

The bands 19 have a multiplicity of substantially rigid clips 23 closely spaced to each other along the entire length of the band. The clips 23 are for the purpose of clamping the marginal edge portions 11.3 of the bottom web 11 of plastic material to the bands 19 for moving the web through the machine as the bands are propelled. It will be seen that each of the clips 23 has a pair of web clamping jaws 23.1 which bear tightly against the band 19 to clamp the edge portion of the web 11 therebetween. A headed stud 24 is essentially riveted to the band 11 at each of the clips 23 for securing the clip to the band. Each of the clips 23 has a keyhole shaped slot 23.2 therein which facilitates removal of the clips from the band 19. Ordinarily, the narrow shanks 24.1 of the headed studs will be disposed in the narrow ends of the keyhole slots 23.2, and the clips 23 are retained in this fixed relation with respect to the band 19 and to the headed studs 24 by downturned lips or flanges 23.3 at the ends of the clips opposite the jaws 23.1.

Each of the clips 23 also has a downturned flange 23.4 which bears against the top surface of the band 19 adjacent its outside edge so as to continuously urge the clip upwardly against the head of the stud 24.

It will be recognized that each of the headed studs 24 is located immediately adjacent a respective aperture 20 in the band 19, and accordingly, each of the apertures 20 is disposed immediately beneath a respective clip 23. When the taut bands 19 pass around the sprockets 21, the sprocket teeth 22 will protrude through the apertures 20 of the band and will engage the adjacent clip 23 so as to lift the clamping jaws 23.1 off the band 19 and into spaced relation with the band. While the jaws 23.1 of the clips are spaced from the band 19, the side edge 11.3 of the bottom web 11 will be inserted beneath the jaw 23.1 or will be removed therefrom, at the opposite ends of the machine. When the band 19 moves, in its endless path, away from the sprocket 21, the sprocket teeth 22 will be extracted from the apertures 20 and the clips 23 will be allowed to resiliently return into clamping relation on the edge portions of the web 11.

The endless band 19 has one joint therein wherein the two end edges 19.1 are abutted together. The joint is made by a hinging connection 25, the opposite sides of which are welded to the end sections of the band 19, and a hinge pin 25.1 connects the two parts of the hinge 25 together. When necessary, the hinge pin 25.1 can be knocked out of the connection so that the band 19 may be readily removed from the machine.

It should be recognized that the jaws 23.1 of the clips 23 are spaced inwardly from the inner edge 19.2 of the band so as to leave a narrow zone 19.3 traversed by the side edge portion 11.3 of the bottom web 11. This support zone 19.3, between the jaws 23.1 and the edge 19.2 provides support for the edge portion 11.3 of the bottom web as the top web 12 is laid over the bottom web 11 in sealing the receptacle or pocket 11.2. A heat sealing device 26, illustrated in FIG. 6, may apply heat downwardly through the edge of the top web 12 and to the edge portion 11.3 of the bottom web as to heat seal the two webs 11 and 12 together at this location while the band 19 and the two webs 11 and 12 are moving through the vacuum chamber 18. As a result of this support zone 19.3 on the side of the band 19, the heat sealing can be accomplished without excessive width of materials so that wastage of the expensive film is avoided. The bands 19 are typically approximately 2.5 inches wide and 0.040 inches thick. The clips 23 may be removed and replaced by simply lifting the lips 23.3 over the adjacent edge of the band 19 and sliding the clip so that the head of the stud 24 will pass through the large end of the keyhole slot 23.2 of the clip.

It will be seen that the present invention provides the carrier 15 in the form of an endless non-stretchable band 19 of stainless steel upon which a multiplicity of clips are provided for clamping the edges of the bottom film 11. The sprocket teeth will lift the clips out of clamping relation with respect to the film so as to allow the film to be moved beneath the jaw, either into clamping relation or away from the band altogether at the outlet of the machine.

What is claimed is:

1. In a machine for packaging items of goods, means for supplying a web of plastic film into the machine and carrier means for gripping and horizontally conveying the web of plastic film for carrying the items thereon, the carrier means including an elongate endless steel band with a top run to support the web of plastic film being conveyed, the band having a multiplicity of clips thereon releasably gripping the edge of the web of plastic film and carrying the film with the band through the machine, each of the clips having a jaw confronting and bearing against the steel band to clamp the film onto the band, and the band having a multiplicity of apertures therethrough each adjacent a respective clip, a sprocket wheel at one end of the top run of the endless band and mounting the band for travel as the sprocket is revolved, the sprocket having a plurality of protrusions each projecting through a respective aperture of the band and bearing against the clip and urging the clip away from the band to open the jaw and allow movement of the web of plastic film between the jaw and the band.

* * * * *